US005998745A

United States Patent [19]

Benassi, Jr. et al.

[11] Patent Number: 5,998,745

[45] Date of Patent: Dec. 7, 1999

[54] VACUUM DETECTION SWITCH

[75] Inventors: Joseph Benassi, Jr., Tewksbury, Mass.; Roger L. Audet, Salem, N.H.; David M. Leclerc, Peabody, Mass.

[73] Assignee: Agfa Corporation, Wilmington, Mass.

[21] Appl. No.: 09/052,692

[22] Filed: Mar. 31, 1998

[51] Int. Cl.[6] ..... H01H 35/24

[52] U.S. Cl. ..... 200/81.4; 200/83 N; 200/512

[58] Field of Search ..... 200/83 A, 83 B, 200/83 N, 83 T, 512, 81.4; 73/104; 271/3.21, 3.22; 347/19

[56] References Cited

U.S. PATENT DOCUMENTS

| | | | |
|---|---|---|---|
| 3,571,542 | 3/1971 | Madden et al. | 200/83 |
| 3,594,522 | 7/1971 | Colglazier et al. | 200/83 B |
| 4,931,601 | 6/1990 | Lavender | 200/83 N |
| 5,818,002 | 10/1998 | Kurtz et al. | 200/834 |

*Primary Examiner*—Renee S. Luebke
*Attorney, Agent, or Firm*—Paul A. Plysher; Robert A. Sabourin; Edward L. Kelley

[57] ABSTRACT

A switch detects a vacuum that is created by suctioning air through a port hole in a media support surface. The switch includes a first layer having (i) a first hole therein which is at least partially aligned with the port hole in the media support surface and (ii) a conductive region, and a second layer, which is disposed above the first layer relative to the media support surface and which is substantially non-conductive. The second layer has a second hole therein which aligns, at least in part, to the first hole in the first layer and to the port hole in the media support surface so as to allow air to flow through the port hole, the first hole, and the second hole. A third layer, which is disposed above the second layer relative to the media support surface, comprises a printed circuit pattern that aligns, at least in part, to the second hole. The printed circuit pattern on the third layer comprises an open circuit. When air is suctioned through the port hole, the first hole and the second hole, a vacuum is created which draws at least a part of the printed circuit pattern through the second hole and into contact with at least a part of the conductive region of the first layer such that the at least part of the conductive region of the first layer completes the open circuit of the printed circuit pattern.

28 Claims, 8 Drawing Sheets

VACUUM DETECTION SWITCH

BACKGROUND OF THE INVENTION

1. Field of the Invention

The present invention is directed to a switch that is used to test a vacuum created by suctioning air through a hole. The invention has particular utility in the printing field, where the switch may be used to test a vacuum that is created between a media support surface, such as a print drum, and a print medium by suctioning air through a port hole in the media support surface.

2. Description of the Related Art

Printing systems of the type described herein operate by holding a print medium, such as a metal plate, against a media support surface, such as a print drum, and etching images onto the print medium using a laser. The accuracy of this type of printing system is dependent, at least in part, upon how securely the print medium is held against the media support surface. More specifically, when the print medium is not held securely against the media support surface, print errors may be caused due to wrinkling of the print medium and/or air bubbles underneath the print medium, among other things.

Several ways have been developed to hold a print medium against a media support surface during printing. For example, one way which has proven effective utilizes a vacuum that is generated by suctioning air through port holes in the media support surface. More specifically, in these systems, the print medium is placed against the media support surface and air is suctioned through the port holes in the media support surface, thereby creating a vacuum between the media support surface and the print medium. This vacuum acts to hold the print medium in place during printing.

As might be expected, the efficacy of such systems depends upon the vacuum used to hold the print medium in place. That is, in the event that the vacuum is not sufficiently strong, or has been compromised due, e.g., to blockages, or the like, in the port holes of the media support surface, attachment of the print medium to the media support surface may be adversely affected. As a result, the print medium may wrinkle, or there may be air bubbles or the like trapped between the media support surface and the print medium, thereby increasing the likelihood of print errors.

Thus, there exists a need for a way in which to test a vacuum which will be created between a media support surface and a print medium before printing actually takes place.

SUMMARY OF THE INVENTION

The present invention addresses the foregoing need by providing a vacuum detection switch which can be used to detect a vacuum created by suctioning air through a port hole in a media support surface, such as a print drum. Specifically, the switch includes three layers, the first two of which include holes that are substantially aligned to the port hole. The first layer also includes a conductive region, and the third layer includes a circuit pattern thereon which comprises an open circuit. In operation, air is suctioned through the port hole and the holes in the first two layers so as to draw the circuit pattern on the third layer into contact with the conductive region on the first layer. This causes the open circuit to be completed, which signals the presence of a predetermined vacuum level.

Thus, according to one aspect, the present invention is a switch which includes a first layer having (i) a first hole therein which is at least partially aligned with a port hole in a media support surface and (ii) a conductive region, and a second layer which is disposed above the first layer relative to the media support surface and which is substantially non-conductive. The second layer has a second hole therein which aligns, at least in part, to the first hole in the first layer and to the port hole in the media support surface so as to allow air to flow through the port hole, the first hole, and the second hole. A third layer, which is disposed above the second layer relative to the media support surface, comprises a printed circuit pattern that aligns, at least in part, to the second hole, the printed circuit pattern on the third layer comprising an open circuit. When air is suctioned through the port hole, the first hole and the second hole, a vacuum is created which draws at least a part of the printed circuit pattern through the second hole and into contact with at least a part of the conductive region of the first layer such that the conductive region of the first layer completes the open circuit of the printed circuit pattern.

In preferred embodiments of the invention, the first and second holes have diameters that correspond to an amount of suction required to draw the printed circuit pattern through the second hole and into contact with the conductive region of the first layer. By varying the diameters of the first and second holes in the switch, it is thus possible to cause the switch to trigger at different vacuum levels. As a result, the invention can be used in a variety of different applications, in addition to the laser printing process described above.

According to another aspect, the invention is a system for testing a vacuum that is created by suctioning air through a plurality of port holes in a media support surface. The system includes a fixture having a shape that roughly corresponds to a shape of the media support surface such that the fixture can be placed in contact with the media support surface. The fixture has a plurality of throughholes therein which align, at least in part, to corresponding port holes in the media support surface so as to allow air to flow through the port holes and the throughholes. A plurality of strips of switches are arrangeable in the fixture such that each switch aligns, at least in part, to one of the plurality of throughholes in the fixture. Each switch is used to determine whether a vacuum created by suctioning air through a corresponding port hole in the media support surface reaches a predetermined level. A plurality of indicators are also included in the system, one indicator corresponding to each switch in the plurality of strips. Each indicator outputs an indication in a case that a switch determines that a vacuum created by suctioning air through a corresponding port hole in the media support surface has reached the predetermined level.

By virtue of the foregoing arrangement, it is possible to detect vacuums levels corresponding to a plurality of port holes on the media support surface. Moreover, because the invention includes plural indicators, each of which corresponds to one of the switches, it is possible to detect an insufficient vacuum level corresponding to a particular port hole, and to react accordingly. In preferred embodiments of the invention, these indicators provide vacuum level indications to a personal computer. The personal computer then displays vacuum level indications for each port hole in the media support surface, thereby further facilitating the testing process.

In other embodiments of the invention, each of the switches includes a vacuum sensor associated therewith which measures a vacuum that corresponds to air flow through a port hole and a throughhole that correspond to the switch. In these embodiments, each vacuum sensor outputs a measurement result to the personal computer for display thereby. By virtue of these features, the invention provides a way in which to advise a user of different vacuum levels corresponding to each port hole in the media support surface. The user can then determine, based on these vacuum levels, what, if any, corrective action needs to be taken with respect to the media support surface and/or the testing system.

According to still another aspect, the invention is a system for testing a air flow through a plurality of port holes in a media support surface. The system includes a fixture having a shape that roughly corresponds to a shape of the media support surface such that the fixture can be placed in contact with the media support surface. The fixture has a plurality of throughholes therein which align, at least in part, to corresponding port holes in the media support surface so as to allow air to flow through the port holes and the throughholes. Also included in the system are a sheet containing a plurality of switches which are arranged to correspond to the plurality of throughholes in the fixture, and a plurality of indicators, one indicator corresponding to each switch in the sheet. Each indicator outputs an indication in a case that a switch is triggered in response to air flowing through a corresponding port hole in the media support surface.

According to still another aspect, the present invention is a method of using a switch to test a vacuum used to hold a print medium against a media support surface. The method includes arranging the switch relative to the media support surface so that (i) a first hole of a first layer of the switch is at least partially aligned with a port hole in the media support surface, (ii) a second hole of a second layer of the switch is at least partially aligned to the first hole in the first layer and to the port hole in the media support surface so as to allow air to flow through the port hole, the first hole and the second hole, and (iii) a printed circuit pattern comprising an open circuit on a third layer of the switch is at least partially aligned to the second hole. In the invention, the switch is configured so that the first layer has a conductive region, the second layer is nonconductive and disposed above the first layer relative to the media support surface, and the third layer is disposed above the second layer relative to the media support surface. According to the invention, air is suctioned through the port hole, the first hole and the second hole, so as to create a vacuum which draws at least a part of the printed circuit pattern through the second hole and into contact with at least a part of the conductive region of the first layer such that the at least part of the conductive region of the first layer completes the open circuit of the printed circuit pattern.

This brief summary has been provided so that the nature of the invention may be understood quickly. A more complete understanding of the invention can be obtained by reference to the following detailed description of the preferred embodiments thereof in connection with the attached drawings.

DETAILED DESCRIPTION OF THE PREFERRED EMBODIMENTS

First Embodiment

Figure 1:
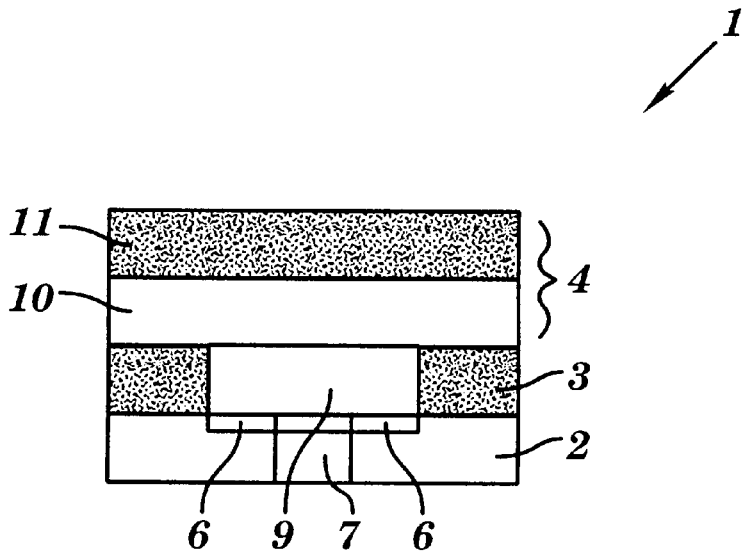
FIG. 1 shows a cut-away view of a vacuum detection switch in accordance with the present invention.
Figure 2:
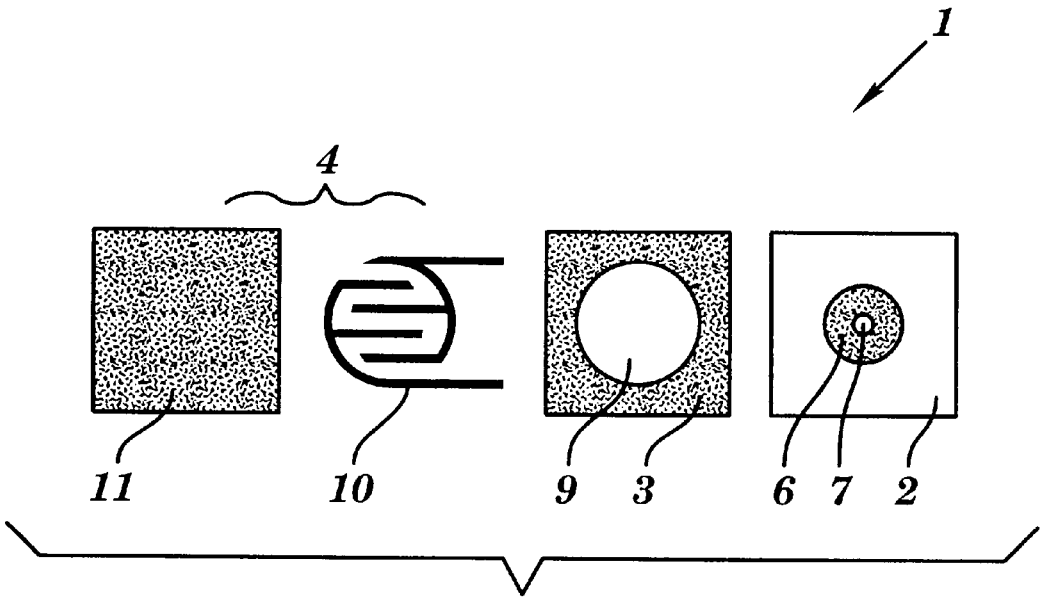
FIG. 2 shows a front view of various layers in the vacuum detection switch shown in FIG. 1.

FIG. 1 shows a side view of a first embodiment of a vacuum detection (i.e., "membrane") switch in accordance with the present invention. As shown in FIG. 1, vacuum detection switch 1 includes layers 2, 3 and 4. A front view of each of these layers is shown in FIG. 2.

Layer 2 is preferably comprised of a non-conductive material, such as polyester, and includes conductive region 6 having hole 7 therethrough. Conductive region 6 may be formed of conductive ink, conductive metal, or the like. In preferred embodiments of the invention, conductive region 6 is substantially circular in shape and is a fraction of an inch in diameter; although it is noted that the invention may utilize conductive regions having shapes and diameters which are different from those of conductive region 6. Hole 7 has a diameter that is less than that of conductive region 6. In this regard, in preferred embodiments of the invention, layer 2 comprises Dow switch sheet #2056, which has a hole with a diameter that is roughly one-sixteenth of an inch. As described in more detail below, this diameter affects operation of vacuum detection switch 1 by limiting the flow of air therethrough.

Layer 3 is comprised of a substantially non-conductive material, such as polyester, and is disposed above layer 2. As shown in FIGS. 1 and 2, layer 3 includes hole 9 therein, which has a diameter that is at least as large as that of conductive region 6, and is preferably greater. In preferred embodiments of the invention, layer 3 is 0.006 inches thick and hole 9 has a diameter of a fraction of an inch. Other thicknesses and hole diameters, however, may be used for layer 3. As shown in FIG. 1, layer 3 is arranged so that hole 9 of layer 3 aligns, at least in part, to hole 7 of layer 2, thereby allowing air to flow through holes 7 and 9.

Layer 4 is disposed above layer 3, and comprises a printed circuit pattern 10 formed of conductive material, such as conductive ink, on a non-conductive material 11, such as polyester. Printed circuit pattern 10 corresponds to an open circuit, such as that found on a conventional membrane switch. Printed circuit pattern 10 is attached to an indicator. In the preferred embodiment of the invention, this indicator is a light-emitting diode (hereinafter "LED") which is triggered by a current of 20 mA. Thus, when the circuit defined by printed circuit pattern 10 is completed (i.e., by contact with conductive region 6, as described below), current is passed therethrough to illuminate the LED.

Figure 3:
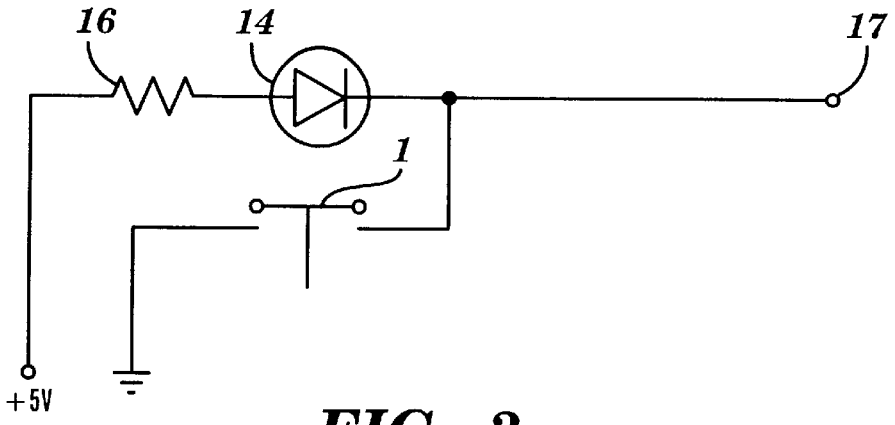
FIG. 3 shows a circuit layout associated with the vacuum detection switch shown in FIGS. 1 and 2.

A circuit diagram illustrating the arrangement of LED 14 and switch 1 is shown in FIG. 3. As shown in FIG. 3, switch 1 is connected to ground and LED 14 is connected to a +5 V power source (not shown) through resistor 16 which, in preferred embodiments of the invention is 250 ohms. When switch 1 closes, current is permitted to flow through LED 14, thereby illuminating the LED. Another lead 17 may also be provided, which alerts a computer, external circuitry, or the like that switch 1 has closed or has opened.

In operation, switch 1 is closed by suctioning air through holes 7 and 9, thereby creating a vacuum within the switch. This, in turn, draws at least a part of printed circuit pattern 10 through hole 9 and into contact with conductive region 6 on layer 2. Conductive region 6 completes the circuit on printed circuit pattern 10, thereby allowing current to flow through, and thus illuminate, LED 14. LED 14 then remains illuminated until the switch opens when the vacuum is removed or goes below a predetermined level sufficient to cause switch 1 to open.

In this regard, it is noted that the invention is not limited to the configuration shown in FIG. 2. That is, printed circuit pattern 10 may be replaced by a conductive region, e.g. the conductive region 6, and may include one electrical lead attached thereto, and conductive region 6 may include another electrical lead attached thereto. As before, these leads may be connected to an indicator, such as LED 14. Thus, in this example, the conductive region which replaces the printed circuit pattern 10 and the conductive region 6 form an open circuit. When the two conductive regions come into contact with each other, current flows through the two conductive regions, via their respective electrical leads. As was the case above, this current flow causes LED 14 to illuminate, thereby providing an indication that the vacuum switch has been triggered.

In any configuration, the vacuum level, i.e., the negative pressure, required to draw printed circuit pattern 10 into contact with conductive region 6 is roughly 7.5 to 13 inches of mercury in the preferred embodiment of the invention. To decrease the vacuum level required to trigger the switch, the sizes of holes 7 and 9 can be increased. Conversely, to increase the vacuum level required to trigger the switch, the sizes of holes 7 and 9 can be decreased. Varying the thickness of layer 3 also can vary the vacuum level required to trigger switch 1.

Figure 4:
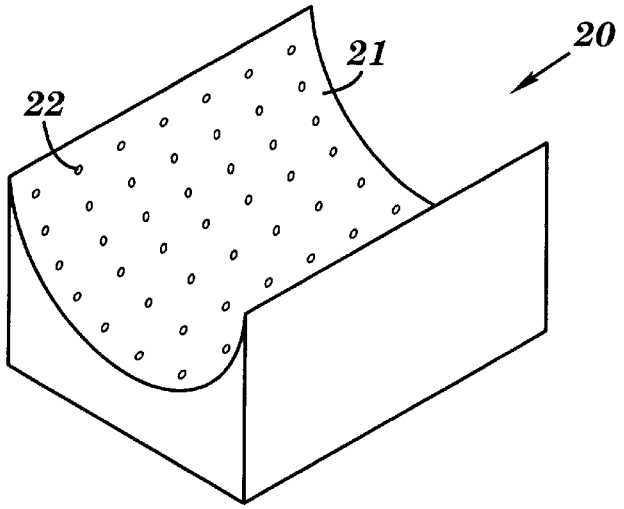
FIG. 4 shows an example of a media support surface, namely a print drum, which may be tested using a vacuum detection switch in accordance with the present invention.

FIG. 4 shows an example of a media support surface which may be tested using vacuum detection switches of the type described above. In this regard, it is noted that the invention may be used to test a variety of different types of media support surfaces having a variety of different shapes. For example, the invention may be used to test flat platens, internal (e.g., concave) print drums, and external (e.g., convex) print drums, among others. Since the operation of the invention is substantially the same for any type of media support surface, for the sake of brevity, the invention will be described herein only with respect to the media support surface shown in FIG. 4, i.e., print drum 20.

As shown in FIG. 4, print drum 20 includes concave inner portion 21 having port holes 22. Through these port holes, air is suctioned in order to create a vacuum which holds a print medium, such as an aluminum sheet, a polyester sheet, a paper sheet, or the like, against print drum 20. The present invention is able to test this vacuum created by suctioning air through these port holes. That is, to test the vacuum created by each port hole, a switch, such as switch 1 described above, is placed over a port hole such that holes 7 and 9 thereof substantially align with the port hole, thereby allowing air to flow through the port hole and holes 7 and 9. In the event that the vacuum reaches a predetermined level, the switch is triggered in the manner described above, as indicated by illumination of LED 14 or by an interfaced computer (see below).

Figure 5:
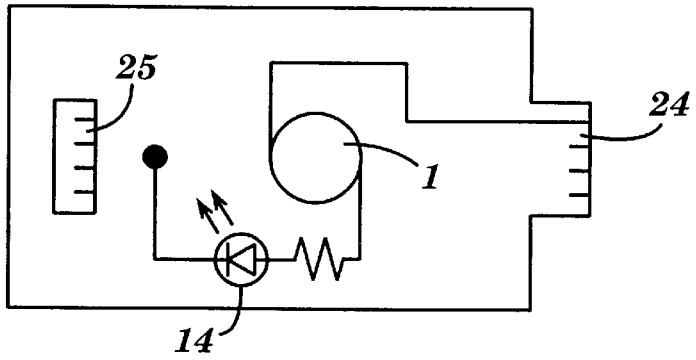
FIG. 5 shows the layout of a vacuum detection switch on a membrane which permits interconnection of plural vacuum detection switches.

To test a plurality of port holes, e.g. all 156 port holes on a conventional print drum, the present invention uses a plurality of strips of switches of the type described above. To this end, as shown in FIG. 5, each switch is placed on a flexible membrane that is roughly 2×3 inches in size and that has connectors 24 and 25 at front and back ends thereof, respectively, for connecting to other such switches in order to form a strip of switches. This configuration of each individual switch makes it possible to form strips of varying numbers of switches and, moreover, facilitates replacement a defective switch within a strip.

Figure 6:
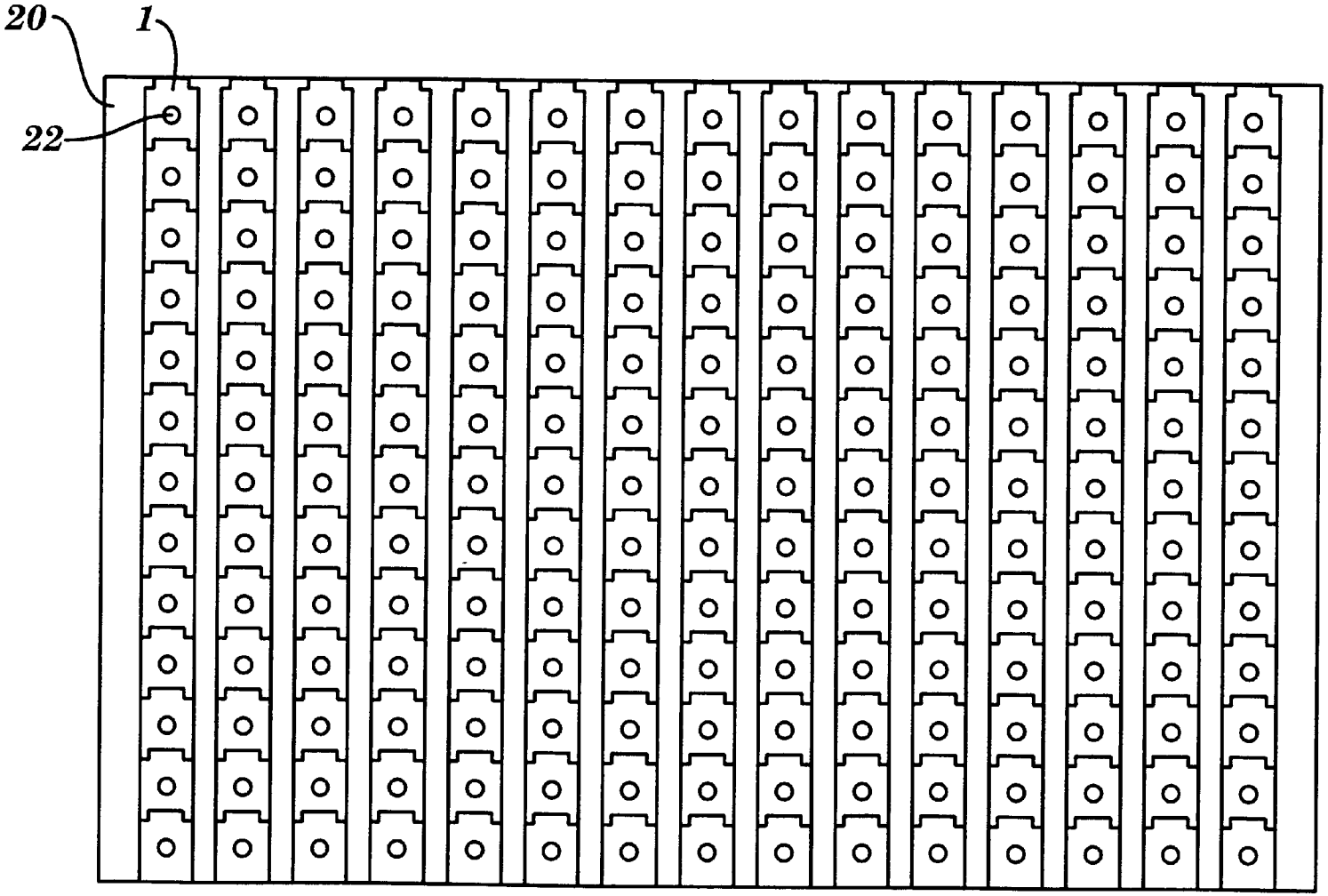
FIG. 6 shows vacuum detection switches arranged directly on a print drum.

In preferred embodiments of the invention, fifteen strips of thirteen switches of the type shown in FIG. 5 each are used to test a print drum; although any number of strips and switches may be used depending upon the size of the drum, the number of port holes therein, etc. As shown in FIG. 6, the strips of switches are arranged on the print drum such that each individual switch aligns, at least in part, to one of the plurality of port holes 22. In this regard, because the switches are formed of flexible materials (e.g., polyester) on a flexible membrane, the switches are able substantially to conform to the concave structure of the print drum.

Figure 7:
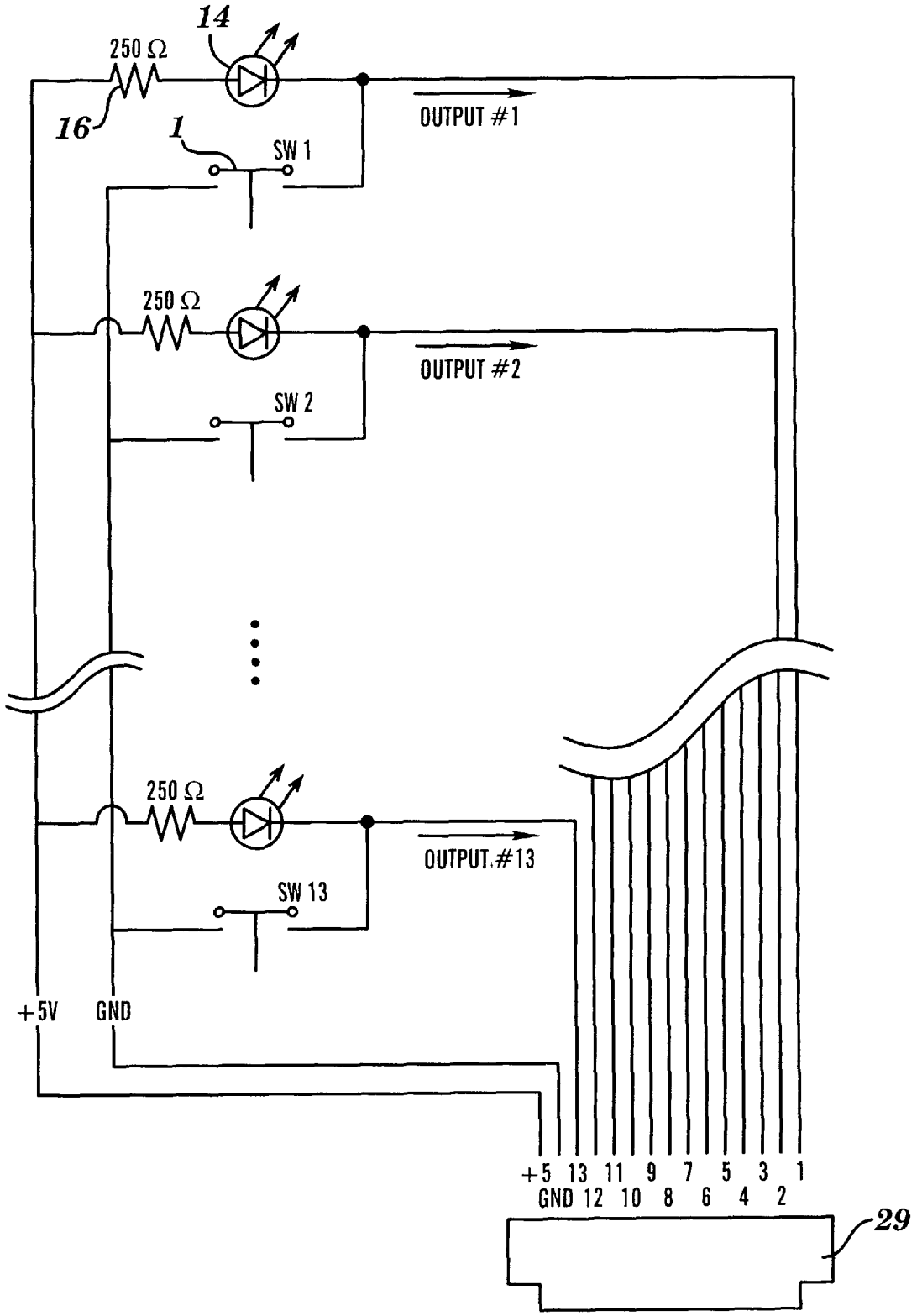
FIG. 7 shows a circuit layout of a strip of vacuum detection switches.

In preferred embodiments of the invention, an output from each switch in the strip is also provided to a personal computer. In this regard, FIG. 7 shows the electrical interconnection between a plurality of switches in a strip. As shown in FIG. 7, the output of each switch is routed to connector 29, such as a Berg 65801-015 connector, which interfaces to a personal computer (not shown). These features of the invention make it possible to provide an indication to the computer of which switches were triggered and which switches were not triggered during a print drum testing process. The computer can then display these results on its display screen. That is, the computer receives an indication from each switch as to whether a vacuum created by suctioning air through a corresponding port hole has reached a predetermined level, and displays indications of which port holes in the print drum cause the vacuum to reach the predetermined level. For example, the computer can display the overall switch layout and then provide an indication of the location of switches that have been triggered or, alternatively, the location of switches which have not been triggered.

Figure 8:
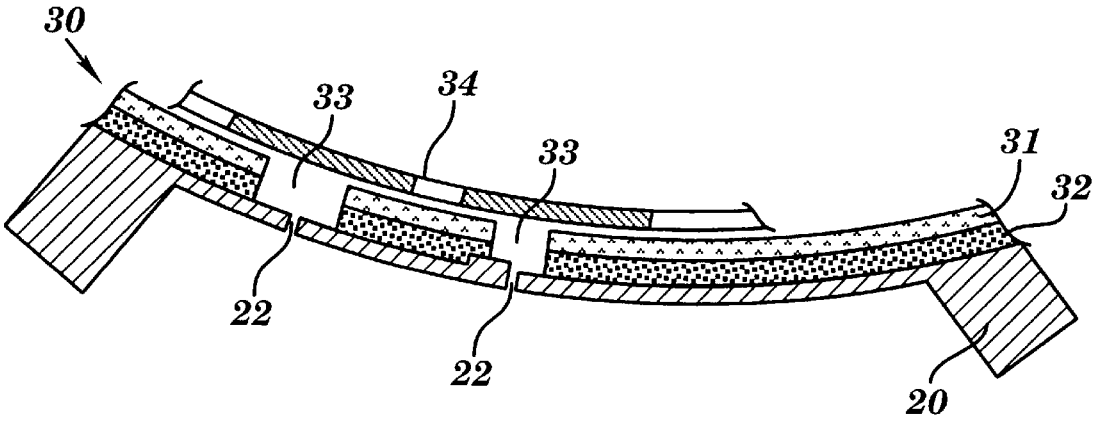
FIG. 8 shows a cut-away side view of the interface between a print drum, a fixture, and a strip of vacuum detection switches.
Figure 9:
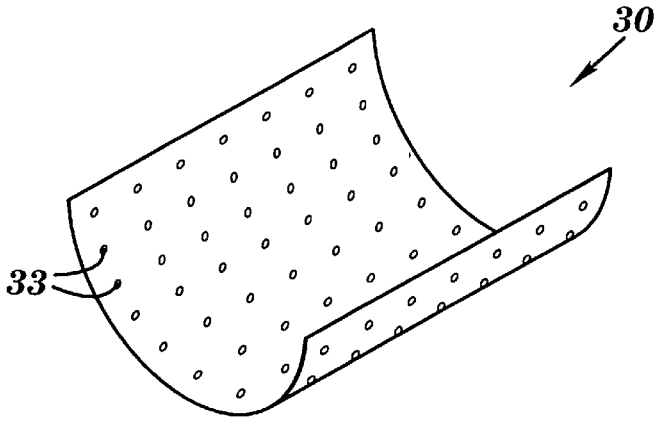
FIG. 9 shows a perspective view of the fixture shown in FIG. 8.

Rather than placing the strips of switches directly onto the print drum, the strips may be arranged on a fixture having a size (e.g., 44×33 inches) and shape that roughly corresponds to the size and shape of the print drum, and which therefore can be placed within the print drum, as shown in the cut-away view of fixture 30 depicted in FIG. 8. A perspective view of fixture 30 is shown in FIG. 9. In this regard, fixture 30 shown in FIG. 9 has a concave shape that substantially corresponds to a shape of print drum 20. It is noted, however, that the shape of fixture 30 need not be concave, and that it can be flat, convex, or any other shape, depending, of course, upon the shape of the print drum with which the fixture is to be used.

As shown in FIGS. 8 and 9, fixture 30 has a plurality of throughholes 33 therein at locations that roughly correspond to port holes 22 in a print drum to be tested. These throughholes are capable of aligning, at least in part, to corresponding port holes in the print drum so as to allow air to flow through the port holes and the throughholes. As shown in the cut-away view of FIG. 8, fixture 30 also includes stiff portion 31 and sealant 32. Stiff portion 31 may be comprised of any stiff material, such as aluminum or the like, which provides structural rigidity and onto which individual switches or strips of switches, such as strip 34, may be arranged. Sealant 32 comprises a soft material, such as a foam gasket or rubber, which is capable of creating a substantially air-tight seal between the stiff portion and the print drum, but which nevertheless permits air to flow through the port holes and the throughholes and into switches arranged on stiff portion 31. In preferred embodiments of the invention, sealant 32 includes an adhesive which holds sealant 32 to stiff portion 31 so as to reduce the chances of movement of sealant 32 relative to stiff portion 31.

In operation, fixture 30 is placed on print drum 20 such that port holes 22 on print drum 20 which are to be tested substantially align to corresponding throughholes 33 in fixture 30, as shown in FIG. 8. Next, a plurality of strips of switches, such as strip 34, are arranged on fixture 30 such that holes (e.g., holes 7 and 9 described above with respect to FIG. 2) in each switch align, at least in part, to corresponding throughholes 33 in fixture 30 (which itself is substantially aligned to port holes 22 in the print drum). Air is then suctioned from port holes 22 in print drum 20, throughholes 33 in fixture 30, and the holes in the layers of each switch arranged on fixture 30. In the event that this air suction is sufficient to create a vacuum having a predetermined level in a particular switch, the switch triggers in the manner described above. An indication that the switch has triggered may then be transmitted to a computer via connector 29 shown in FIG. 7. The computer can then display a switch layout showing which switches were triggered (e.g., by illuminating green lights corresponding to those switches) and which switches were not triggered (e.g., by illuminating red lights corresponding to those switches). As noted above, an LED indicator on each switch also may illuminate in the event that the switch triggers.

Figure 10:
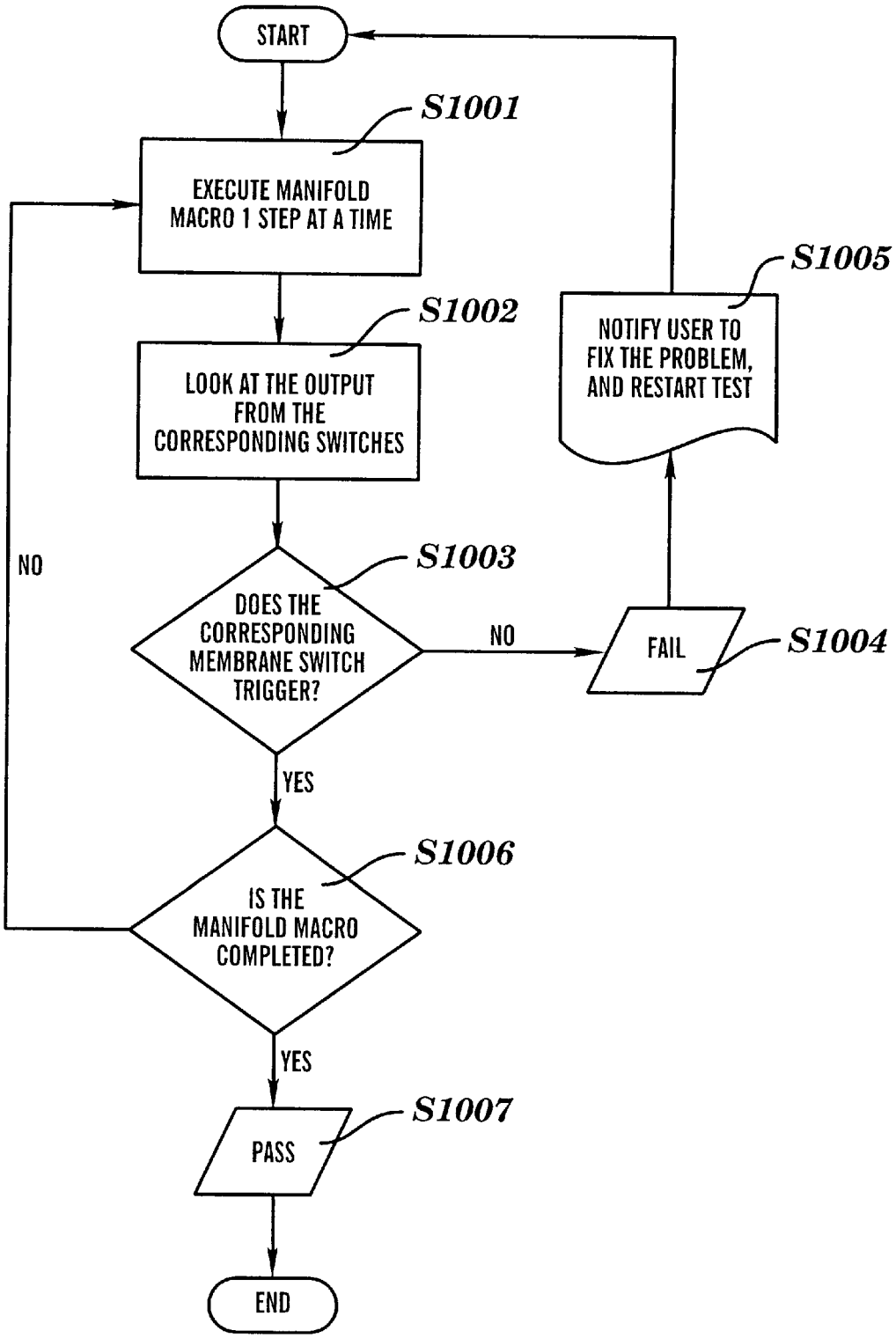
FIG. 10 is a flow diagram showing a computerized test routine using a vacuum detection switch.

The foregoing information relating to switch triggering can be used in conjunction with a software routine for testing operation of a vacuum used to hold a recording medium against a print drum. FIG. 10 is a flow diagram showing process steps that are executed by a computer during this testing process. More specifically, step S1001 comprises executing the software test routine, referred to in FIG. 10 as the "manifold macro". Next, step S1002 examines the output from a switch on the print drum. Step S1003 then determines whether the switch examined in step S1002 has been triggered. In a case that the switch has not been triggered, flow proceeds to step S1004, which ascertains that there is a problem with the vacuum generated by the print system or with the port hole corresponding to the untriggered switch. Thereafter, flow proceeds to step S1005, which notifies the user that there is a problem, and that the test software should be re-executed once the problem has been resolved.

On the other hand, if step S1003 determines that the switch did trigger, flow proceeds to step S1006. Step S1006 determines whether the software routine has been completed, i.e., whether the outputs of all switches have tested positively, meaning all switches have been triggered. In such a case, flow proceeds to step S1007, which confirms that the vacuum generated via all port holes on the print drum (or only all port holes being tested) is at a predetermined level (e.g., between 7.5 and 13 inches of mercury). In such a case, processing ends. Returning to step S1006, in a case that step S1006 determines that the software routine has not been completed, i.e., that there are still outputs of switches that need to be tested, flow returns to step S1001, whereafter the foregoing process is repeated until the outputs of all switches have been tested.

Second Embodiment

In the second embodiment of the invention, the switches described above can be replaced by, or can include therein, vacuum sensors which measure levels of vacuum created by air suction through the port holes of the drum. These measured vacuum values can then be transmitted to a computer and displayed in a manner similar to the way that the switch outputs described above were transmitted and displayed.

In preferred embodiments of the invention, the vacuum sensors comprise two polyester sheets having a grid pattern thereon which roughly corresponds to a port hole pattern on a print drum, and a pressure sensitive conductive ink sandwiched between the polyester sheets at locations that roughly correspond to the locations of the port holes in the print drum. Numerical measurements are then taken of the pressure sensitive conductive ink to determine the level of the vacuum created by air suction from a particular port hole, and these numerical measurements are passed on to the computer.

An alternative vacuum sensor which may be used in this embodiment of the invention is a piezoresistive transducer, which is capable of outputting measurement results in the form of a voltage that corresponds to a vacuum. An example of such a vacuum sensor is a Motorola MPX5100DP sensor, or other sensors in the Motorola MPX5100 series. In the context of a print drum testing process, the voltage output by such a sensor may be digitized and analyzed by the computer and the results thereof displayed to a user in the manner described above.

Figure 11A:
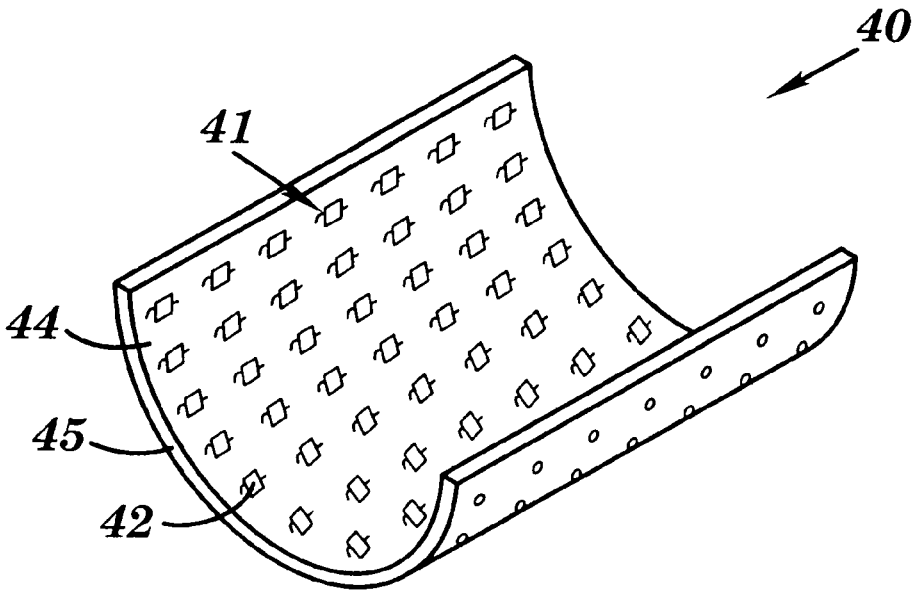
FIG. 11A shows a fixture for testing a print drum using a vacuum sensor in accordance with a second embodiment of the invention.

FIG. 11A shows a fixture 40 for use in testing a print drum, such as print drum 20. As shown in FIG. 11A, fixture 40 includes stiff portion 44 and sealant 45. These features of fixture 40 are identical in structure and function to corresponding features of fixture 30 shown in FIG. 9. Accordingly, detailed descriptions thereof are omitted here for the sake of brevity.

Figure 11B:
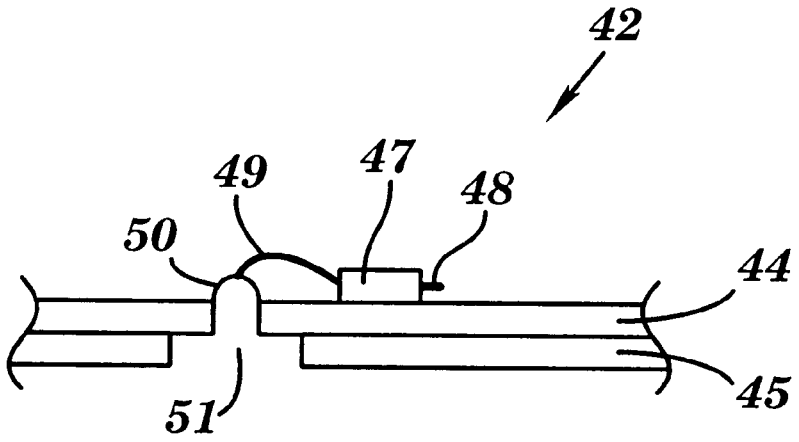
FIG. 11B is a close-up, cut-away view of one of the vacuum detection switches of FIG. 11A.

Also shown in FIG. 11A are plural vacuum detection switches 41 in accordance with the second embodiment of the invention. As was the case above, each of vacuum detection switches 41 is arranged to correspond to a hole on fixture 40, and thus to a port hole on a print drum to be tested using fixture 40. FIG. 11B is a close-up, cut-away view of one of these vacuum detection switches, namely vacuum detection switch 42, which includes a vacuum sensor of the type described above.

In this regard, vacuum detection switch 42 includes sensor 47 having electrical connection 48, tubing 49, and cup 50. These features of the invention are used to measure a vacuum based on air suctioned through hole 51. More specifically, cup 50 substantially blocks hole 51 so that air can be suctioned through tubing 49. Sensor 47 then measures this suction, and relays the measurement results to a computer via electrical connection 48. Thereafter, the computer may display numerical measurement results for each of switches 41. Thus, in this embodiment of the invention, the computer may display an indication of the location of the switch together with the measurement of the vacuum level in that switch.

At this point, it is noted that vacuum sensor 47 may also be incorporated into vacuum detection switch 1 shown in FIG. 1, thereby providing, in one switch, the benefits of both the first and second embodiments described herein. For example, tube 11 may be run through non-conducive material 11 and into hole 9 shown in FIG. 1, thereby providing a way for vacuum sensor 47 to measure air suctioned through holes 7 and 9 of vacuum detection switch 1.

Third Embodiment

In the third embodiment of the invention, the switches described above in the first and second embodiments are replaced with "flaps" in a sheet having conductive and non-conductive portions. These flaps, when in contact with the sheet, each close a circuit that corresponds to a particular port hole on a print drum. In a case that one of these flaps is moved, e.g., by the application of compressed air or air suction, the circuit corresponding to that flap breaks. By monitoring breaks in circuits corresponding to particular port holes on the print drum, it is possible to determine whether air is capable of flowing through the port holes. This information can then be relayed to a personal computer for display, analysis, or the like in a manner similar to that described above. Similarly, a corresponding LED or the like, can be arranged to indicate which port holes cause a circuit break.

Figure 12A:
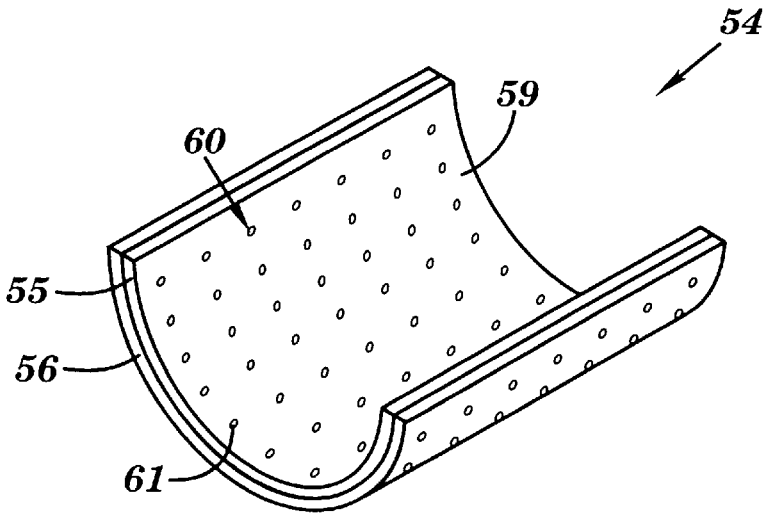
FIG. 12A shows a fixture for testing a print drum using "flap" switches in accordance with a third embodiment of the invention.
Figure 12B:
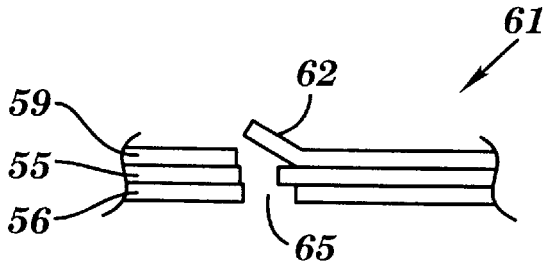
FIG. 12B is a cut-away, side view of one of the switches of FIG. 12A.
Figure 12C:
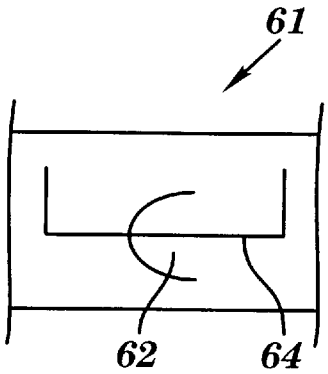
FIG. 12C is a top view of the switch of FIG. 12B.

FIGS. 12A, 12B and 12C show the third embodiment of the invention in detail. In this regard, FIG. 12A shows a fixture 54 for use for use in testing a print drum, such as print drum 20. As shown in FIG. 12A, fixture 54 includes stiff portion 55 and sealant 56. These features of fixture 54 are identical in structure and function to corresponding features of fixture 30 shown in FIG. 9. Accordingly, detailed descriptions thereof are omitted here for the sake of brevity.

Also shown in FIG. 12A is sheet 59 containing plural switches 60 in accordance with the third embodiment of the invention. As was the case above, each of switches 60 is arranged to correspond to a hole on fixture 54, and thus to a port hole on a print drum to be tested using fixture 54. FIG. 12B is a close-up, cut-away view of one of these switches, namely switch 61, and FIG. 12C, is a top view of switch 61.

In this regard, switch 61 includes flap 62 which is disposed between conductive leads of circuit 64 (see FIG. 12C). As was the case above with respect to printed circuit pattern 10, circuit 64 may be connected to a corresponding LED or other type of indicator, which is capable of indicating a break in circuit 64. Thus, in operation, when air is passed through hole 65, flap 62 moves, thereby breaking circuit 64. This movement is indicated via, e.g., the corresponding LED. At this point, it should be noted that, in this embodiment of the invention, unlike those described above, compressed air flow, as opposed to suction, may also be used to trigger switch 61. In fact, FIG. 12B shows a configuration whereby compressed air flow can be used to trigger switch 61. In this regard, the amount of air flow required to trigger switch 61 can be varied by varying, e.g., the material comprising flap 62. That is, in the case that flap 62 is made of a relatively heavy, or thick, material, more air flow will be required to trigger switch 62 than if flap 62 is made of a relatively thin, or light, material. The present invention has been described with respect to particular illustrative embodiments. It is to be understood that the invention is not limited to the above-described embodiments and modifications thereto, and that various changes and modifications may be made by those of ordinary skill in the art without departing from the spirit and scope of the appended claims.

What is claimed is:

1. A switch for detecting a vacuum that is created by suctioning air through a port hole in a surface, the switch comprising:

a first layer having (i) a first hole which is at least partially aligned with the port hole in the surface and (ii) a first conductive region;

a second layer, which is disposed above the first layer relative to the surface and which is substantially non-conductive, the second layer having a second hole which aligns, at least in part, to the first hole in the first layer and to the port hole in the surface so as to allow air to flow through port hole, the first hole and the second hole; and a third layer which is disposed above the second layer relative to the surface and which comprises a second conductive region that aligns, at least in part, to the second hole, the second conductive region including an open circuit;

wherein, when air is suctioned through the port hole, the first hole and the second hole, a vacuum is created which closes the switch by drawing at least a part of the second conductive region through the second hole and into contact with at least a part of the first conductive region of the first layer such that the first conductive region completes the open circuit on the second conductive region.

2. A switch according to claim 1, wherein the first and second holes have diameters corresponding to an amount of suction required to draw the second conductive region through the second hole and into contact with the first conductive region.

3. A switch according to claim 1, further comprising an indicator electrically connected to the second conductive region, said indicator indicating whether the vacuum has reached a predetermined level.

4. A switch according to claim 3, wherein the indicator comprises a light emitting diode.

5. A switch according to claim 3, wherein the indicator comprises a computer display screen.

6. A switch according to claim 3, wherein at least one of the second conductive region and the first conductive region is formed from conductive ink.

7. A switch according to claim 1, wherein the surface is located on a print drum.

8. A switch according to claim 1, wherein the surface provides support for media.

9. A switch according to claim 1, wherein the second conductive region comprises a printed circuit.

10. A system for testing a vacuum created by suctioning air through a plurality of port holes in a media support surface, the system comprising:

a fixture having a shape that substantially corresponds to a shape of the media support surface such that the fixture can be placed within the media support surface, the fixture having a plurality of throughholes therein which align, at least in part, to corresponding port holes in the media support surface so as to allow air to flow through the port holes and the throughholes;

a plurality of strips of switches which are arrangeable in the fixture such that each switch aligns, at least in part, to one of the plurality of throughholes in the fixture, each switch for determining whether a vacuum created by suctioning air through a corresponding port hole in the media support surface reaches a predetermined level; and a plurality of indicators, one indicator corresponding to each switch in the plurality of strips, each indicator for outputting an indication in a case that a switch determines that a vacuum created by suctioning air through a corresponding port hole in the media support surface has reached the predetermined level.

11. A system according to claim 10, further comprising a personal computer which receives an indication from each of the plurality of switches as to whether a vacuum created by suctioning air through a corresponding port hole has reached the predetermined level, and which displays indications of which port holes in the media support surface cause the vacuum to reach the predetermined level.

12. A system according to claim 10, wherein each of the plurality of switches comprises:

a first layer having (i) a first hole therein which is at least partially aligned with a port hole in the media support surface and a corresponding throughhole in the fixture, and (ii) a conductive region;

a second layer, which is disposed above the first layer relative to the media support surface and which is substantially non-conductive, the second layer having a second hole therein which aligns, at least in part, to the first hole in the first layer, to the throughhole in the fixture, and to the port hole in the media support surface so as to allow air to flow through the port hole, the throughhole, the first hole and the second hole; and a third layer, which is disposed above the second layer relative to the media support surface and which comprises a printed circuit pattern that aligns, at least in part, to the second hole, the printed circuit pattern comprising an open circuit;

wherein, when air is suctioned through the port hole, the throughhole in the fixture, the first hole, and the second hole, a vacuum is created which draws at least a part of the printed circuit pattern through the second hole and into contact with at least a part of the conductive region of the first layer such that the at least part of the conductive region of the first layer completes the open circuit of the printed circuit pattern.

13. A system according to claim 12, wherein completing the open circuit of the printed circuit pattern causes an indicator corresponding to the switch to indicate that the that the vacuum created by suctioning air through the port hole in the media support surface that corresponds to the switch has reached the predetermined level.

14. A system according to claim 12, wherein the first and second holes have diameters which correspond to an amount of suction required to draw the printed circuit pattern through the second hole and into contact with the conductive region of the first layer.

15. A system according to claim 12, wherein the indicator comprises a light emitting diode.

16. A system according to claim 12, wherein at least one of the printed circuit pattern and the conductive region is formed from conductive ink.

17. A system according to claim 10, further comprising a personal computer;

wherein each of the switches includes a vacuum sensor associated therewith which measures a vacuum that corresponds to air flow through a port hole and a throughhole that correspond to the switch, each vacuum sensor outputting measurement results to the personal computer for use thereby.

18. A system according to claim 10, wherein the fixture is comprised of a stiff portion and a sealant, the sealant for creating a substantially air-tight seal between the stiff portion and the media support surface; and wherein the plurality of switches are arrangeable in the stiff portion of the fixture.

19. A system according to claim 10, wherein the media support surface comprises a print drum.

20. A system for testing air flow through a plurality of port holes in a media support surface, the system comprising:

a fixture having a shape that substantially corresponds to a shape of the media support surface such that the fixture can be placed within the media support surface, the fixture having a plurality of throughholes therein which align, at least in part, to corresponding port holes in the media support surface so as to allow air to flow through the port holes and the throughholes;

a sheet containing a plurality of switches which are arranged to correspond to the plurality of throughholes in the fixture; and a plurality of indicators, one indicator corresponding to each switch in the sheet, each indicator for outputting an indication in a case that a switch is triggered in response to air flowing through a corresponding port hole in the media support surface.

21. A system according to claim 20, wherein each switch in the sheet of switches comprises a flap and a circuit, the flap being disposed between different portions of the circuit; and wherein the flap moves in response to a predetermined amount of one of air compression and air suction through the corresponding port hole in the media support surface.

22. A system according to claim 20, wherein the media support surface comprises a print drum.

23. A method of using a switch to test a vacuum used to hold a print medium against a media support surface, the method comprising the steps of:

arranging the switch relative to the media support surface so that (i) a first hole of a first layer of the switch is at least partially aligned with a port hole in the media support surface, the first layer of the switch including a conductive portion thereon, (ii) a second hole of a second layer of the switch is at least partially aligned to the first hole in the first layer and to the port hole in the media support surface so as to allow air to flow through the port hole, the first hole and the second hole, the second layer of the switch being nonconductive and disposed above the first layer relative to the media support surface, and (iii) a printed circuit pattern comprising an open circuit on a third layer of the switch is at least partially aligned to the second hole, the third layer of the switch being disposed above the second layer relative to the media support surface; and suctioning air through the port hole, the first hole and the second hole so as to create a vacuum which draws at least a part of the printed circuit pattern through the second hole and into contact with at least a part of the conductive region of the first layer such that the at least part of the conductive region of the first layer completes the open circuit of the printed circuit pattern.

24. A method according to claim 23, further comprising the step of passing current through the printed circuit pattern after the first layer completes the printed circuit pattern.

25. A method according to claim 24, wherein the current is used to provide an indication that the vacuum created by suctioning air through the port hole has at least a predetermined vacuum level.

26. A method according to claim 23, wherein the arranging step comprises arranging the switch on a fixture having a shape that substantially corresponds to a shape of the media support surface such that the fixture can be placed within the media support surface, the fixture having a plurality of throughholes therein which align, at least in part, to corresponding port holes in the media support surface so as to allow air to flow through the port holes and the throughholes.

27. A method according to claim 23, further comprising the step of measuring a vacuum level created by suctioning air through the port hole of the media support surface.

28. A method according to claim 27, further comprising the step of:

providing a measurement of the vacuum level made in the step measuring step to a personal computer; and displaying, on the personal computer, an indication of a location of the switch together with the measurement of the vacuum level.

* * * * *